United States Patent [19]

Holmes et al.

[11] Patent Number: 4,858,723

[45] Date of Patent: Aug. 22, 1989

[54] BUCKET LEVELING SYSTEM

[75] Inventors: William K. Holmes, Delafield; John J. Mlaker, Milwaukee, both of Wis.

[73] Assignee: Hi-Ranger, Inc., Waukesha, Wis.

[21] Appl. No.: 226,144

[22] Filed: Jul. 29, 1988

[51] Int. Cl.[4] ..... B66F 11/04

[52] U.S. Cl. ..... 182/2; 182/141

[58] Field of Search ..... 182/2, 141

[56] References Cited

U.S. PATENT DOCUMENTS

| | | | |
|---|---|---|---|
| 2,606,078 | 8/1952 | Brock | 182/2 |
| 2,724,620 | 11/1955 | Johnson | 182/2 |
| 3,590,948 | 7/1971 | Milner | 182/2 |
| 4,757,875 | 7/1988 | Hade, Jr. | 182/2 |
| 4,775,029 | 10/1988 | MacDonald | 182/2 |

*Primary Examiner*—Reinaldo P. Machado

*Attorney, Agent, or Firm*—Michael, Best & Friedrich

[57] ABSTRACT

An aerial lift includes a bucket mounted at the outer end of an articulated boom assembly having upper and lower booms. A hydraulic cylinder is provided for extending the upper boom relative to the lower boom, and a rotary actuator is provided for varying the rotational position of the bucket relative to the upper boom. An auxiliary cylinder, actuated in response to actuation of the upper boom hydraulic cylinder, provides hydraulic fluid to the rotary actuator so as to maintain the bucket in a substantially level position as the articulated boom assembly is raised and lowered. The load train including a chain and sector-shaped sprocket automatically compensate upper boom angle for changes in the angle of the lower boom relative to horizontal so that the rotary actuator is actuated only in response to actual changes in the angular position of the upper boom relative to horizontal.

34 Claims, 3 Drawing Sheets

BUCKET LEVELING SYSTEM

BACKGROUND OF THE INVENTION

This invention relates generally to aerial lifts and, more particularly, to bucket leveling systems for automatically leveling a bucket of an aerial lift as the bucket is raised and lowered.

Aerial lifts of the type having a passenger bucket or platform mounted at the end of a tower assembly comprised of articulated upper and lower booms, typically require some provision for keeping the bucket level as the angle of the upper boom changes relative to horizontal. In prior art aerial lifts, the bucket is mounted at the end of the upper boom for rotation around a generally horizontal axis, and the rotational position of the bucket is controlled by means of cables housed in the upper and lower booms and reeved over a sheave fixed to the bucket. During use, the cables cause movement of the bucket in response to changes in the angular position of the booms. In addition to providing an automatically leveled bucket, this arrangement locks the bucket against free-swinging rotation around the axis and thus provides, at all times, a rigid working platform regardless of changes in the elevation of the boom assembly. However, the cables in such a lift may be subject to stretching over time and may tend to slap against the interior of the upper and lower booms as the aerial lift is moved from one site to another. Excessive backlash, wear, platform sag, a general loss of effectiveness and a need for frequent readjustment can result.

In view of the foregoing, it is a general object of the present invention to provide an improved bucket leveling system for use in aerial lifts.

It is a more specific object of the present invention to provide an aerial lift bucket leveling system wherein the disadvantages associated with the use of long cables are avoided.

SUMMARY OF THE INVENTION

The invention provides, in an aerial lift having a tower assembly comprised of articulated upper and lower booms and a passenger platform mounted on the tower assembly, a platform leveling system comprising a hydraulically actuated motor operable to support the platform with respect to a substantially horizontal axis and means responsive to the raising of the boom for hydraulically actuating the motor to maintain the platform in a substantially constant predetermined orientation relative to vertical as the tower assembly is raised and lowered.

The invention also provides an aerial lift including a tower assembly including a lower boom and an upper boom and having a bucket mounted to an end of the upper boom. Hydraulic means are provided at that end of the upper boom for causing tilting movement of the bucket relative to the upper boom around a substantially horizontal axis. An upper boom lift cylinder is also provided for extending the upper boom relative to horizontal and relative to the lower boom. Means are also provided for operably connecting the hydraulic lift cylinder to the means for causing tilting of the bucket to thereby maintain the bucket in a substantially constant predetermined orientation relative to vertical as the articulated boom assembly is extended and retracted.

In one embodiment of the invention the means for causing tilting of the bucket is a hydraulically operated rotary actuator coupled to the bucket so as to controllably rotate the bucket around a substantially horizontal axis and thereby vary the angle between the bucket and the upper boom. An auxiliary cylinder is also provided and is actuated by extension and retraction of the rod of the upper boom lift cylinder. This auxiliary cylinder supplies hydraulic fluid to the rotary actuator. The displacements of the rotary actuator and auxiliary cylinder are proportioned so that with upper boom motion, the bucket angle remains constant to horizontal.

In one embodiment of the invention the auxiliary cylinder is mounted alongside and substantially parallel to the upper boom lift cylinder and includes an auxiliary piston coupled to, and movable with, the piston rod of the upper boom lift cylinder.

It is a principal feature of the invention to provide an aerial lift wherein a passenger-carrying bucket is automatically maintained in a substantially level position by means of a hydraulically operated rotary actuator.

It is another principal feature of the present invention to provide an aerial lift having a tower assembly including an elongate upper boom wherein mechanical communication from the lower end of the tower assembly to the upper end of the upper boom is provided by means of hydraulic fluid flow through hydraulic lines rather than by means of cables or direct mechanical linkages.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
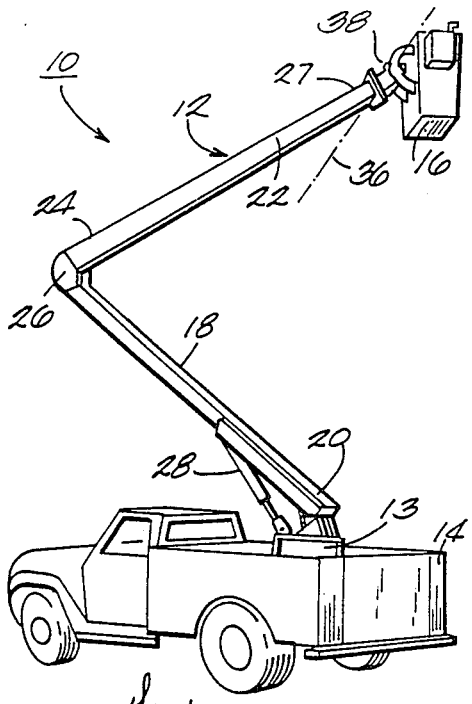
FIG. 1 is a perspective view of an aerial lift including a bucket leveling system embodying various aspects of the invention.

Referring to the drawings, and, in particular, to FIG. 1, an aerial lift 10 includes an tower assembly 12 mounted on a stable pedestal 13 in turn mounted on truck 14 or other vehicle, and further includes a passenger-carrying platform or bucket 16 mounted at one end of the tower assembly 12. As illustrated, the tower assembly 12 includes a lower boom 18 having one end 20 pivotally supported by a turntable 15 mounted on the pedestal 13. The tower assembly 12 further includes an upper boom 22 having an end 24 pivotally connected, by means of an elbow joint 26, to an end of the lower boom 18, and an upper end 27 on which the platform or bucket 16 is mounted. A hydraulically operated lower boom lift cylinder 28, connected between the lower boom 18 and the turntable 15, operates to raise the lower boom 18 relative to the turntable 15. An upper boom lift cylinder assembly 30 (FIGS. 2 and 4), housed within the lower boom 18 and having a main cylinder rod 32 extending from a main cylinder 34, operates to pivot the upper boom 22 relative to the lower boom 18 at the elbow 26. Together, the upper and lower cylinder assemblies 28 and 30 function to extend and retract the tower assembly 12 and thereby raise or lower the platform or bucket 16.

To maintain the passenger-carrying platform or bucket 16 in a level or otherwise predetermined orientation relative to vertical as the tower assembly 12 is raised and lowered, the platform or bucket 16 is preferably mounted to the distal end 27 of the upper boom 22 for pivoting movement around a substantially horizontal axis 36. A hydraulic rotary actuator 38 is mounted adjacent the distal end 27 of the upper boom 22 and is coupled so as to controllably rotate the platform or bucket 16 around the horizontal axis 36 and thereby change the relative angle between the bucket 16 and the upper boom 22. In addition, means, responsive to movement of the upper boom 22 with respect to the lower boom 18, are provided for hydraulically actuating the rotary actuator 38 so as to maintain the passenger platform or bucket 16 in a substantially constant predetermined orientation relative to vertical as the upper boom 22 is raised and lowered.

In the illustrated embodiment, the height and position of the bucket 16 can be changed by varying the angle of the lower boom 18 relative to the truck 14 and by varying the angle of the upper boom 22 relative to the lower boom 18. However, to maintain the platform or bucket 16 in a level position, it is necessary to rotate the platform or bucket 16 around the horizontal axis 36 only when the angle of the upper boom 22 relative to horizontal is varied. The tower assembly 12 is constructed such that as the lower cylinder 28 operates, the angle of the upper boom 22 relative to horizontal stays constant without requiring compensating simultaneous extension or retraction of the upper hydraulic cylinder assembly 30. When so constructed, the angle of the upper boom 22 relative to horizontal can be changed only by actuating the upper boom lift cylinder assembly 30. Because the angular position of the upper boom 22 relative to horizontal is varied only in response to extension or retraction of the main cylinder rod 32 of the upper boom lift cylinder assembly 30, the upper hydraulic cylinder assembly 30 provides an effective reference for controlling the operation of the rotary actuator 38 so as to maintain the passenger platform or bucket 16 in the predetermined orientation as the articulated boom assembly 12 is raised and lowered.

Figure 4:
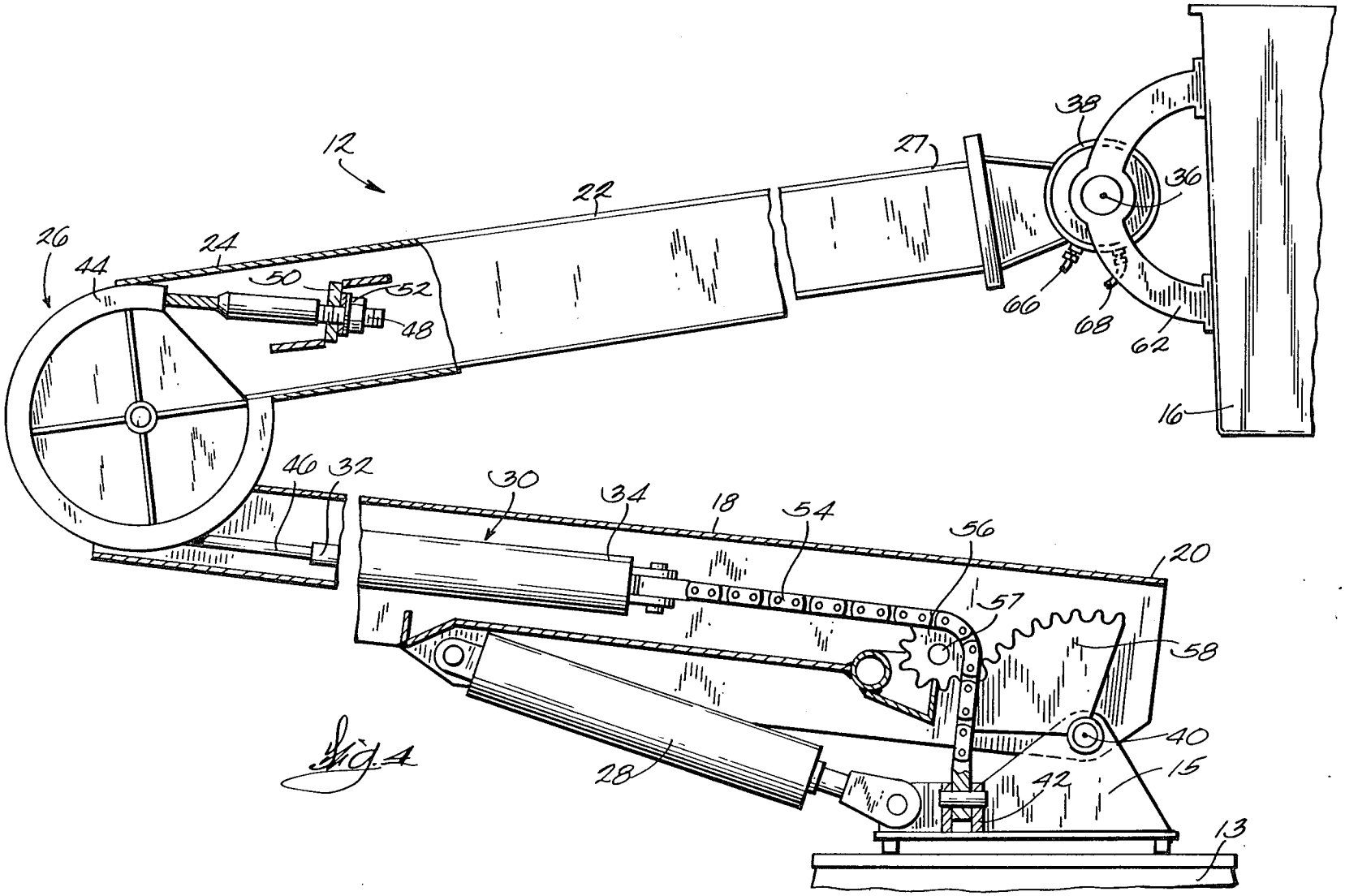
FIG. 4 is a side elevation view, partially in section, of the articulated boom assembly of the aerial lift shown in FIG. 1.

The mechanism for keeping the angle between the upper boom 22 and horizontal constant as the lower cylinder 28 varies the angular position of the lower boom 18, is illustrated in FIG 4. Referring to this figure, each of the upper and lower booms 22 and 18 preferably comprises an elongate hollow structure. The lower end 20 of the lower boom 18 is pivotally supported by the turntable 15 for pivotal movement with respect to a substantially horizontal axis 40. The cylinder end of the lower cylinder assembly 28 is pivotally coupled to the underside of the lower boom 18 at a point spaced away from the horizontal axis 40, and the rod end of the lower cylinder assembly 28 is pivotally connected to the turntable 15.

At the elbow joint 26, the proximate end of the upper boom 22 is affixed to a rotatable elbow sheave 44 rotatably supported at the upper end of the lower boom 18. A flexible cable 46 is anchored to the interior of the upper boom 22 at a point adjacent the proximate end 24 and along a line tangent to the circumference of the elbow sheave 44. The other end of the cable 46 is reeved around the sheave 44 and into the interior of the lower boom 18 where it is connected to the piston rod 32 of the upper hydraulic cylinder assembly 30. Extension and retraction of the piston rod 32 causes the upper boom 22 to pivot around the axis of the elbow sheave 44. Preferably, the end of the flexible cable 46 is connected to the interior of the upper boom 22 by means of a threaded rod 48 extending through an anchor point 50 and retained by means of a nut and washer 52 so that limited adjustment can be made to the effective length of the flexible cable 46.

As further illustrated in FIG. 4, the upper cylinder assembly 30 is movable within the interior of the lower boom 22 in the direction of the longitudinal axis of the cylinder 30 and is retained by means of a chain 54 having one end fixed to the cylinder 34. The chain 54, in turn, is reeved between a pinion sprocket 56 supported on a pin 57, in turn, supported by the lower end of the lower boom 18 and a sector-shaped sprocket 58 centered on the horizontal pivot axis 40 and having a radius substantially equal to the radius of the elbow sheave 44. The remaining end of the chain 54 is anchored to the turntable 15 by a bracket 42.

In use, extension of the lower cylinder assembly 28 causes the lower boom 18 to pivot around the horizontal axis 40. At the same time, the pinion sprocket 56 forces the chain 54 onto the outer periphery of the sector-shaped sprocket 58 with the result that the upper hydraulic cylinder assembly 30 is pulled axially along the interior of the lower boom 18 toward the lower end thereof. Such movement of the upper cylinder assembly 30 pulls the flexible cable 46, causing the upper boom 22 to rotate in a counterclockwise direction as viewed in FIG. 4 and thereby change the relative angle between the upper and lower booms 22 and 18. However, because the lower boom 18 is, at the same time, rotating in a clockwise direction relative to the horizontal pivot axis 40, because the radius of the sector-shaped sprocket 58 substantially equals the radius of the elbow sheave 44, and because the sheave 44 has a constant radius, the angle of the upper boom 22 relative to horizontal remains unchanged as the lower boom 18 rotates in either direction around the horizontal pivot axis 40. Only by extending or retracting the main cylinder rod 32 of the upper hydraulic cylinder assembly 30, can the angular position of the upper boom 22 relative to horizontal be varied.

Figure 3:
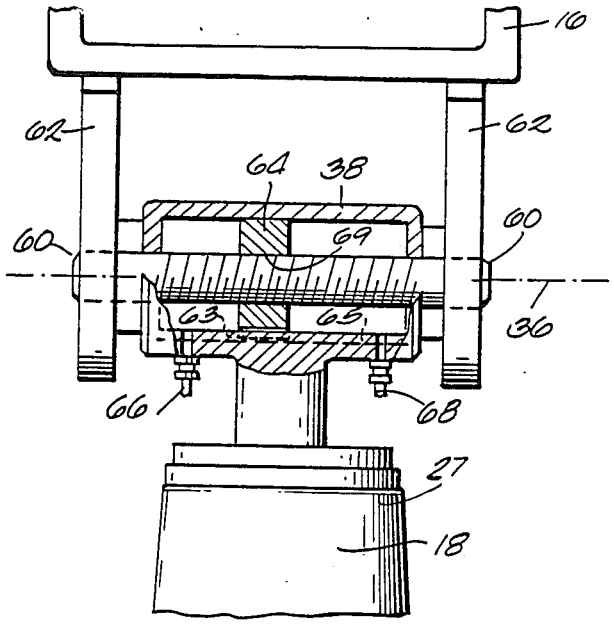
FIG. 3 is a top plan view, partially in section, of the distal end of the upper boom of the articulated boom assembly of the aerial lift shown in FIG. 1, showing the mounting of a passenger bucket to the distal end of the upper boom and further showing a rotary actuator for changing the tilt position of the bucket relative to the upper boom.

As illustrated in FIG. 3, the passenger-carrying platform or bucket 16 is mounted for pivoting movement around the substantially horizontal axis 36 by means of the hydraulically operated rotary actuator 38 horizontally mounted to the distal end 27 of the upper boom 22. The opposite ends of a rotatable shaft 60 extend from the opposite ends of the rotary actuator 38, and each of the opposite ends supports a substantially U-shaped bracket 62, the brackets 62 in turn supporting the bucket 16. An axially movable piston, positioned within the rotary actuator housing, is driven, from either end of the housing toward the other, by means of hydraulic fluid supplied and drained through a pair of hydraulic lines 66 and 68. A helical and spline arrangement of known construction translates linear movement of the piston 64 into rotary movement of the shaft 60. Generally, the piston 64 includes a spline 63 housed in a groove 65 in the wall of the cylinder 71 to prevent rotation of the piston 64 with respect to the cylinder 71. The piston also includes a central threaded bore 61 housing the threaded rotatable shaft 60 such that linear movement of the piston 64 will cause rotation of the shaft 60 about its longitudinal axis.

When hydraulic fluid is supplied to the hydraulic rotary actuator 38 through one of the lines 66 or 68 and drained from the actuator through the other of the lines 66 or 68, the shaft 60 is caused to rotate in one direction, while reversing the direction of fluid supply to the rotary actuator causes the shaft 60 to rotate in the opposite direction. In this manner, bi-directional pivoting movement of the platform or bucket 16 can be provided by controlling the direction of hydraulic fluid flow through the rotary actuator 38.

Figure 5:
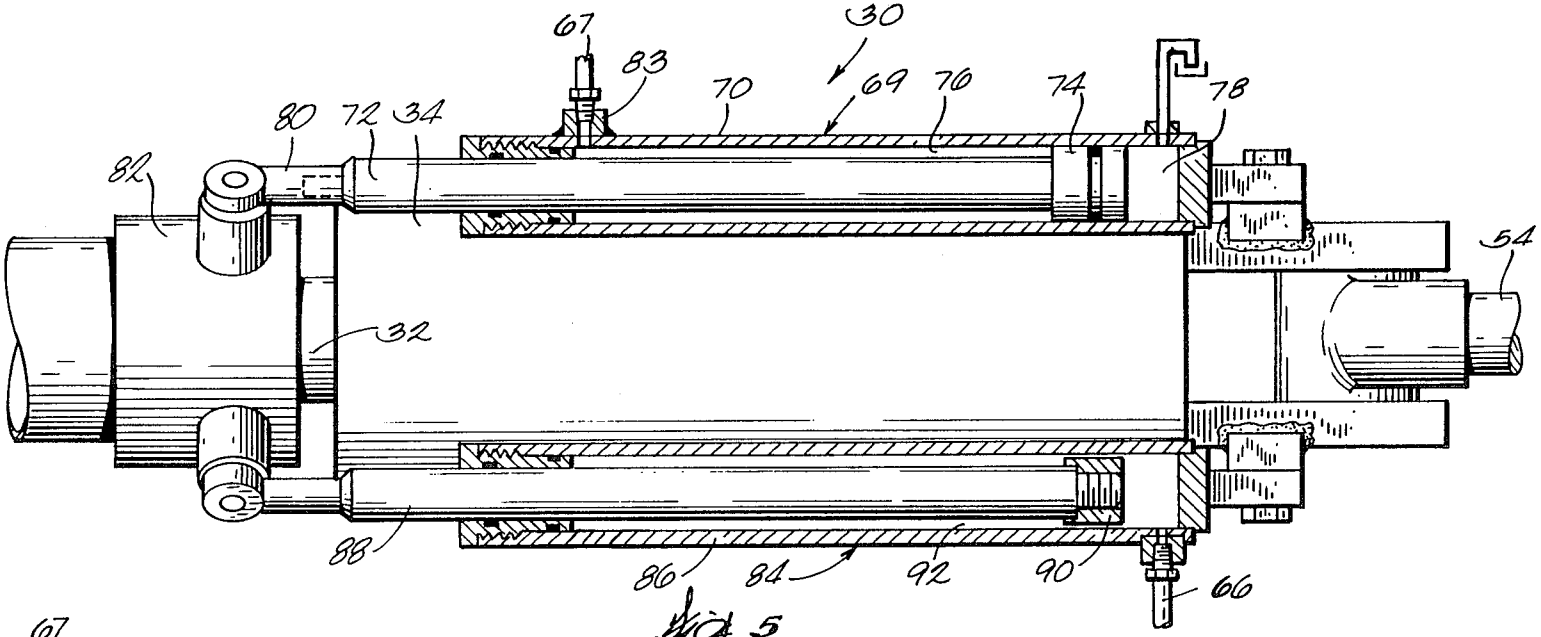
FIG. 5 is a fragmentary top plan view, partially in section, of a hydraulic cylinder assembly useful in the bucket leveling system and embodying various features of the invention.

In order to operate the rotary actuator 38 so as to maintain the platform or bucket 16 in the predetermined orientation, means are provided for discharging, under pressure, a quantity of hydraulic fluid proportional to the degree of extension of the upper hydraulic cylinder assembly 30. To this end, the upper cylinder assembly 30 includes, as best illustrated in FIG. 5, a first auxiliary cylinder assembly 69 having a first elongate auxiliary cylinder 70 mounted alongside and substantially parallel to the main cylinder 34. A first auxiliary piston rod 72 is reciprocably mounted in the first auxiliary cylinder 70, and a piston 74 divides the interior of the first auxiliary cylinder 70 into first and second chambers 76 and 78. One end 80 of the first auxiliary piston rod 72 extends from an end of the first auxiliary cylinder 70 and is fixed, by means of a collar or bracket 82, to the main piston rod 32. When thus connected, extension of the main piston rod 32 results in extension of piston rod 72 from the cylinder 70. This, in turn, reduces the volume of the first chamber 76 by an amount proportional to the extension of the piston rod 32. Similarly, retraction of the piston rod 32 causes piston rod 72 to move inwardly relative to cylinder 70 thereby increasing the volume of the first chamber 76. A hydraulic fluid port 83 communicates with the first chamber 76 so that hydraulic fluid can be discharged from, or received in, the first chamber 76 in accordance with the direction of movement piston rod 32.

Figure 2:
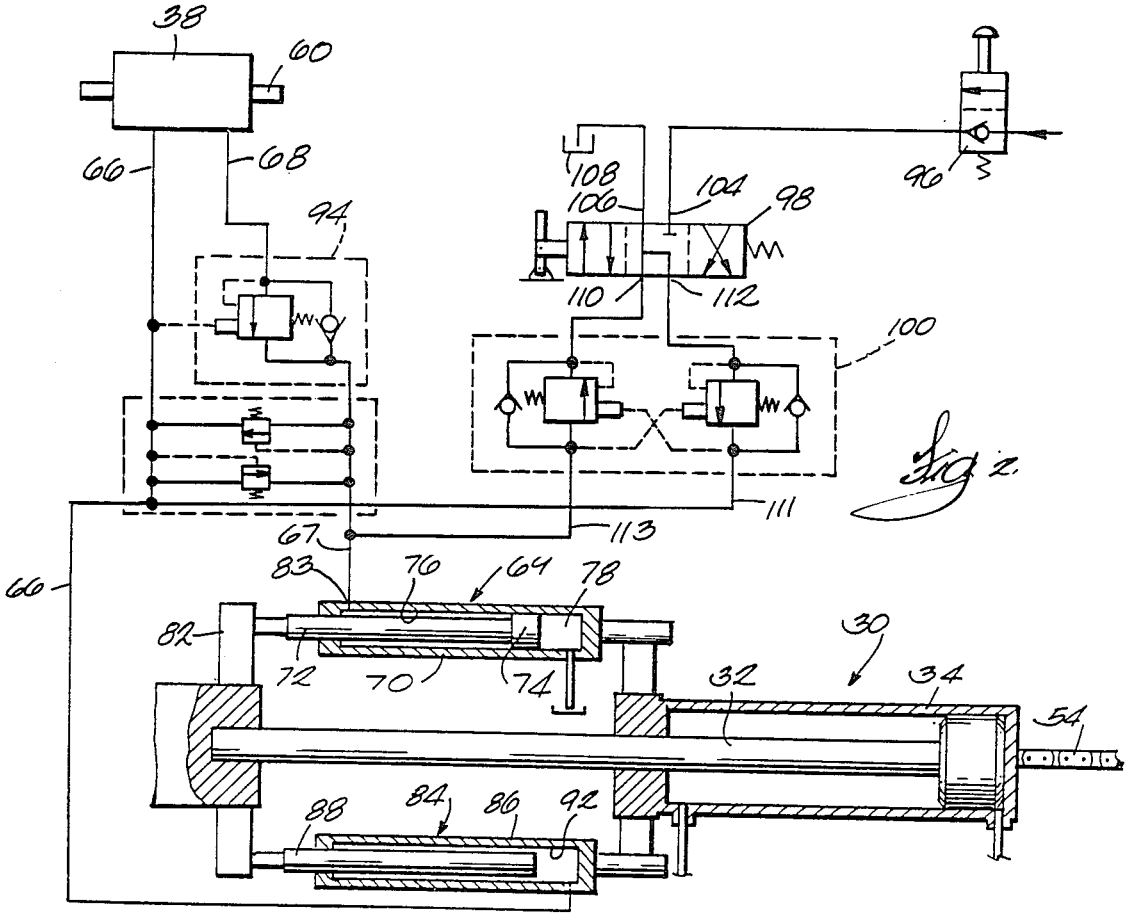
FIG. 2 is a simplified schematic diagram of a hydraulic system included in the bucket leveling system of the aerial lift shown in FIG. 1.

As illustrated in FIG. 2, the first chamber 76 of the first auxiliary cylinder 69 is coupled through hydraulic fluid lines 67 and 68 to one end of the rotary actuator 38. When hydraulic fluid is supplied to the main cylinder 34, piston rod 32 is extended causing hydraulic fluid to be discharged from the first chamber 76 of the first auxiliary cylinder 69 to the rotary actuator 38. This has the effect of rotating the platform or bucket 16 so as to compensate for changes in the angle of the upper boom 22 relative to horizontal. Because piston rod 72 is coupled to piston rod 32, the quantity of hydraulic fluid discharged to the rotary actuator 38, and, therefore, the angular rotation of the platform or bucket 16, is directly related to the degree of extension of rod 32 and, thus, to the change in the angular position of the upper boom 22 relative to horizontal. Expressed differently, the volume of the chamber 76 and the volume of the cylinder of the rotary actuator are selected so that the angle of movement of the bucket is the same as the angle of movement of the upper boom.

Figure 7:
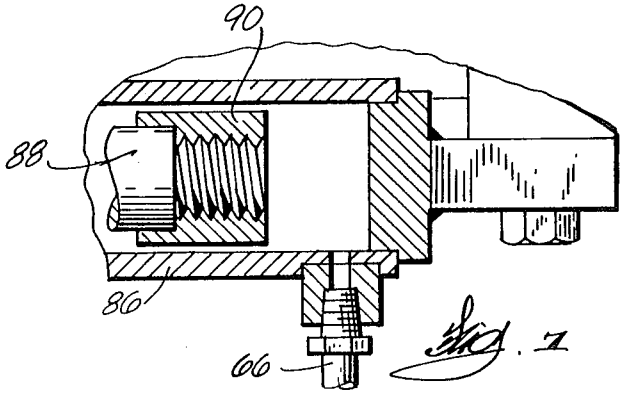
FIG. 7 is an enlarged fragmentary view of a portion of the hydraulic cylinder assembly illustrated in FIG. 5.
Figure 6:
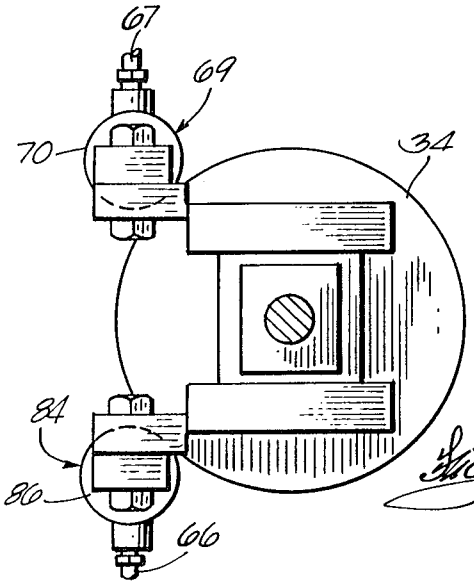
FIG. 6 is an end view of the hydraulic cylinder assembly illustrated in FIG. 5.

The upper cylinder assembly 30 further includes a second auxiliary cylinder assembly 84 having an elongate cylinder 86 and a piston rod 88 reciprocably mounted within the cylinder 86 and coupled for movement with the piston rod 32. Unlike the first auxiliary cylinder assembly 69, the second auxiliary cylinder 84 does not include a piston within the interior of the second auxiliary housing. Instead, the end of the second auxiliary cylinder rod 88 terminates, as best seen in FIG. 7, in a guide member 90 around which a gap is maintained relative to the interior of the second auxiliary housing 86. Thus, only a single continuous chamber 92 is formed in the interior of the second auxiliary housing 86, and the volume of the continuous chamber 92 changes in accordance with changes in the extension of the second auxiliary cylinder rod 88 with respect to the second auxiliary housing 86. Preferably, the first and second auxiliary cylinders 70 and 86, along with the first and second auxiliary piston rods 72 and 88, are dimensioned so that the volume of the chamber 92 within cylinder 84 increases by the precise amount that the volume of the first chamber 76 within cylinder 69 decreases as the main cylinder rod 32 extends. This can be accomplished, for example, by providing a piston rod 88 having a cross sectional area substantially equal to the net rod end area of the cylinder 70.

As also illustrated in FIG. 2, the chamber 92 of cylinder 84 is coupled through the hydraulic line 66 to the rotary actuator 38. In this manner, when hydraulic fluid is forced from the first chamber 76 through lines 67 and 68 into one end of the rotary actuator, hydraulic fluid is forced through the line 66 from the rotary actuator 38 to the chamber 92 of the second auxiliary cylinder assembly 84. When the main piston rod 32 is retracted, piston rod 88 is forced into the cylinder 86, while the piston 74 moves so as to increase the volume of the first chamber 76. This has the effect of forcing hydraulic fluid through line 66 into the rotary actuator 38 in the reverse direction so as to rotate the bucket 16 in the opposite direction and thereby maintain the bucket 16 in a level position as the angle of the upper boom 22 relative to horizontal changes in the opposite direction.

In order to prevent runaway movement of the platform or bucket 16 in the event the hydraulic line 67 to the rotary actuator 38 fails, a counterbalance valve 94 (FIG. 2) is provided in the hydraulic lines 67 and 68 leading to the rotary actuator 38 at a point closely adjacent the rotary actuator 38. In a preferred form of the invention the hydraulic line 68 between the counterbalance valve 94 and the rotary actuator 38 is a steel conduit. The counterbalance valve 94 functions to permit operation of the rotary actuator 38 in the event pressurized hydraulic fluid is supplied to the actuator through either hydraulic lines 67 or 68. However, in the event hydraulic fluid under pressure is not being supplied to the rotary actuator 38, the counterbalance valve 94 acts as a check valve to prevent hydraulic fluid flow from the actuator 38 through fluid lines 67 and 68. Thus, if the hydraulic line 67 should fail, and fluid is not supplied to the actuator 38 under pressure, the counterbalance valve 94 operates to lock the rotary actuator 38 and thereby prevent rotation of the platform or bucket 16.

Although the aerial lift 10 is configured so as to automatically maintain the platform or bucket 16 in a level position as the articulated boom assembly 12 is raised and lowered, it is sometimes desirable to controllably rotate the bucket 16 around the horizontal axis 36 so as to place the bucket 16 in other than a level position. For example it may be necessary to tilt the bucket 16 to dump accumulated rain water. To this end, the aerial lift preferably includes additional or override hydraulic circuitry for actuating the rotary actuator 38 independently of the upper hydraulic cylinder assembly 30.

As illustrated in FIG. 2, such additional or override hydraulic circuitry includes a user-actuable palm valve 96, a four-way hydraulic valve 98, and dual counterbalance valves 100 connected so as to supply hydraulic fluid to the rotary actuator 38 independently of the upper hydraulic cylinder assembly 30. The palm valve 96 is connected between a source of pressurized hydraulic fluid and port 104 of the four-way valve 98. Port 106 of the four-way valve 98 is connected to a hydraulic fluid reservoir 108. Port 112 of the four-way valve 98 is coupled through the dual counterbalance valves 100 and a hydraulic line 111, to the second auxiliary cylinder 84 and to the hydraulic line 66 leading to the rotary actuator 38. A remaining port 110 is connected through a hydraulic line 113 and the dual counter balance valves 100 to the remaining hydraulic line 67 leading to the rotary actuator 38.

When the four-way valve 98 is operated so as to connect the ports 106 and 104 with the ports 110 and 112, respectively, closure of the palm valve 96 causes hydraulic fluid to flow to the rotary actuator 38 through the hydraulic lines 113, 67 and 68 and from the rotary actuator 38 through the hydraulic line 66. This has the effect of rotating the bucket 16 in the counterclockwise direction around the horizontal axis 36 as viewed in FIG. 1. When the four-way valve 98 is operated so as to connect the inlet ports 106 and 104 with the outlet ports 112 and 110, respectively, hydraulic fluid is supplied to the rotary actuator 38 through the hydraulic lines 111 and 66 and is returned from the rotary actuator 38 through the hydraulic line 67. This has the effect of rotating the bucket 16 in the clockwise direction as viewed in FIG. 1. In both cases, the angular position of the upper boom 22 relative to horizontal remains unchanged.

To prevent inadvertent or unintended actuation of the override circuitry, the palm valve 96 and the four-way valve 98 are preferably each spring loaded so that each valve must be consciously and deliberately actuated in order to actuate the rotary actuator 38 independently of the upper hydraulic cylinder assembly 30.

Because the rotational position of the platform or bucket 16 is controlled by means of a hydraulically actuated rotary actuator 38, mechanical communication between the proximate and distal ends 24 and 26 of the upper boom 22 can be provided by means of hydraulic lines 66 and 67. This arrangement eliminates the need for physically movable cables running the length of the upper boom 22 and thus avoids the drawbacks associated with such systems.

Although the invention has been described in the context of an aerial lift 10 having an articulated boom assembly 12, it will be appreciated that the bucket leveling system can also be utilized in an aerial lift having a single boom raised and lowered, for example, by a hydraulic cylinder assembly similar or identical in construction and operation to the upper hydraulic cylinder assembly 30 described herein. In addition, it will be appreciated other types of hydraulically actuated motors, such as a conventional hydraulic cylinder, can be used in place of the rotary actuator 38.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

We claim:

1. In an aerial lift having a tower assembly and a passenger platform supported by the tower assembly, a platform leveling system comprising:

a hydraulically actuated motor supported by the tower assembly and operable to pivot the passenger platform around a substantially horizontal axis, the hydraulically actuated motor including a cylinder having a central longitudinal axis colinear with said horizontal axis and a piston housed in the cylinder and shiftable in the direction of the longitudinal axis of the cylinder, the cylinder including hydraulic fluid chambers at its opposite ends, the hydraulic fluid chambers being separated by the piston, and means for causing rotation of the piston in response to shiftable movement of the piston in the direction of the longitudinal axis, one of the piston and cylinder being fixed to the tower assembly and the other of the piston and cylinder supporting the passenger platform; and means responsive to raising of the tower assembly for hydraulically actuating said motor to maintain the passenger platform in a substantially constant predetermined orientation relative to vertical as the tower assembly is raised and lowered.

2. A platform leveling system in accordance with claim 1 wherein said hydraulically actuated motor is positioned adjacent the passenger platform and wherein said means for hydraulically actuating said motor is remote from said hydraulically actuated motor.

3. A platform leveling system in accordance with claim 2 wherein the aerial lift includes a hydraulic cylinder for raising the tower assembly and wherein said means for hydraulically actuating said motor are positioned adjacent the hydraulic cylinder.

4. A platform leveling system in accordance with claim 3 wherein the tower assembly includes an upper boom, a lower boom, and an upper hydraulic cylinder assembly having a cylinder and a piston for raising the upper boom relative to the lower boom, and wherein said means for hydraulically actuating said motor respond to extension of the upper hydraulic cylinder.

5. A platform leveling system in accordance with claim 4 wherein said means for hydraulically actuating said motor includes an auxiliary cylinder assembly responsive to extension of the upper hydraulic cylinder so as to discharge to said motor a quantity of hydraulic fluid proportional to the degree of extension of the upper hydraulic cylinder assembly.

6. A platform leveling system in accordance with claim 5 wherein said auxiliary cylinder assembly is fixed to said upper hydraulic cylinder assembly such that extension of said upper hydraulic cylinder assembly causes extension of said auxiliary cylinder assembly.

7. A platform leveling system in accordance with claim 6 wherein said auxiliary cylinder assembly includes an auxiliary cylinder and an auxiliary piston rod, one of said auxiliary cylinder and said auxiliary piston rod being fixed to said cylinder of said upper hydraulic cylinder assembly and the other of said auxiliary cylinder and said auxiliary piston rod being fixed to said piston of said upper hydraulic cylinder assembly.

8. A platform leveling system in accordance with claim 1 wherein said hydraulically actuated motor comprises a rotary actuator.

9. A aerial lift comprising:

a tower assembly including a lower boom and an upper boom, said upper boom having a proximate end pivotably connected to one end of said lower boom and a distal end opposite said proximate end;

a bucket mounted to said distal end of said upper boom;

hydraulic means adjacent said distal end of said upper boom for causing tilting movement of said bucket relative to said upper boom around a substantially horizontal axis, the hydraulic means including a cylinder having a central longitudinal axis colinear with said horizontal axis and a piston housed in the cylinder and shiftable in the direction of the longitudinal axis of the cylinder, the cylinder including hydraulic fluid chambers at its opposite ends, the hydraulic fluid chambers being separated by the piston, and means for causing rotation of the piston in response to shiftable movement of the piston in the direction of the longitudinal axis, one of the piston and cylinder being fixed to the distal end of the upper boom and the other of the piston and cylinder supporting the bucket;

means for controllably varying the angle of said upper boom relative to said horizontal axis so as to controllably extend and retract said tower assembly; and means responsive to extension of said tower assembly for actuating said hydraulic means so as to tilt said bucket relative to said upper boom as said angle of said upper boom relative to horizontal changes and thereby maintain said bucket in a substantially constant predetermined orientation relative to vertical as said tower assembly is extended and retracted.

10. An aerial lift in accordance with claim 9 wherein said means for controllably varying the angle if said upper boom comprises an upper hydraulic cylinder assembly and wherein said means responsive to extension of said tower assembly responds to extension and retraction of said upper hydraulic cylinder assembly.

11. An aerial lift in accordance with claim 10 wherein said hydraulic means adjacent said distal end of said upper boom comprises a rotary actuator and wherein said means responsive to extension of said tower assembly forces hydraulic fluid to said rotary actuator in one direction in response to extension of said upper hydraulic cylinder assembly and forces hydraulic fluid to said rotary actuator in the opposite direction in response to retraction of said upper hydraulic cylinder assembly.

12. An aerial lift in accordance with claim 11 wherein said means responsive to extension of said tower assembly includes first and second auxiliary cylinder assemblies coupled to said upper hydraulic cylinder assembly, one of said first and second auxiliary cylinder assemblies being adapted to discharge hydraulic fluid to said rotary actuator in response to extension of said upper hydraulic cylinder assembly and the other of said first and second auxiliary cylinder assemblies being adapted to discharge hydraulic fluid to said rotary actuator in response to retraction of said upper hydraulic cylinder assembly.

13. An aerial lift in accordance with claim 12 wherein said first and second auxiliary cylinders are fixed to said upper hydraulic cylinder assembly such that extension of said upper hydraulic cylinder assembly causes extension of said first and second auxiliary cylinders.

14. An aerial lift in accordance with claim 13 wherein each of said first and second auxiliary cylinder assemblies includes a cylinder and a piston rod, one of said cylinder or piston rod being fixed to the cylinder of said upper hydraulic cylinder assembly and the other of said cylinder and piston rod being fixed to the piston rod of said upper hydraulic cylinder assembly.

15. An aerial lift comprising:

a support structure;

a lower boom having a lower end pivotably connected to said support structure and an upper end opposite said lower end;

an upper boom having a proximate end pivotably connected to said upper end of said lower boom, said upper boom further having a distal end opposite said proximate end and a longitudinal axis extending between said distal and proximate ends;

a bucket carried at said distal end of said upper boom, said bucket having an upper portion and a lower portion and having a longitudinal axis extending between upper and lower portions;

a hydraulically operated rotary actuator mounted to said distal end of said upper boom and coupled to said bucket so as to controllably rotate said bucket around a substantially horizontal axis and thereby vary the angle between said longitudinal axis of said bucket and said longitudinal axis of said upper boom, the hydraulically operated rotary actuator including a cylinder having a central longitudinal axis colinear with said horizontal axis and a piston housed in the cylinder and shiftable in the direction of the horizontal axis, the cylinder including hydraulic fluid chambers at its opposite ends, the hydraulic fluid chambers being separated by the piston, and means for causing rotation of the piston in response to shiftable movement of the piston in the direction of the horizontal axis, one of the piston and cylinder being fixed to the distal end of the upper boom and the other of the piston and cylinder supporting the bucket;

a first hydraulic cylinder operable to vary the angle of said lower boom relative to said support structure;

a second hydraulic cylinder having an extendable and retractable rod coupled to said boom and operable to vary the angle of said upper boom relative to said lower boom in response to extension and retraction of said rod; and an auxiliary cylinder actuable in response to extension and retraction of said rod to supply hydraulic fluid to said rotary actuator, in a quantity substantially proportional to the extension of said rod, and thereby actuate said rotary actuator so as to maintain a substantially constant predetermined angle between said longitudinal axis of said bucket and said longitudinal axis of said upper boom as said rod is extended and retracted.

16. An aerial lift in accordance with claim 15 wherein said aerial lift includes a pair of said auxiliary cylinders arranged so that one of said auxiliary cylinders supplies hydraulic fluid to said rotary actuator in response to extension of said rod while the other of said auxiliary cylinders supplies hydraulic fluid to said rotary actuator in response to retraction of said rod.

17. An aerial lift in accordance with claim 16 wherein said auxiliary cylinders are arranged so that as one of said auxiliary cylinders supplies hydraulic fluid to said rotary actuator, the other of said auxiliary cylinders receives hydraulic fluid discharged from said rotary actuator.

18. A hydraulic cylinder assembly for controlling the extension of an upper boom relative to a lower boom in an aerial lift having an articulated boom assembly, said hydraulic cylinder assembly;

an elongate main cylinder housing;

a main cylinder rod reciprocably mounted within said main cylinder housing and having an end projecting from one end of said main cylinder housing;

an elongate auxiliary cylinder housing mounted alongside and substantially parallel to said main cylinder housing;

an auxiliary cylinder rod reciprocably mounted in said auxiliary cylinder housing;

a piston head coupled to and movable with said auxiliary cylinder rod within said auxiliary cylinder so as to divide the interior of said auxiliary cylinder into first and second chambers; and means for coupling said auxiliary cylinder rod for movement with said main cylinder rod so that the volume of said first chamber decreases while the volume of said second chamber increases as said main cylinder rod moves in one direction, and so that the volume of said first chamber increases while the volume of said second chamber decreases as said main cylinder rod moves in the opposite direction.

19. is A hydraulic cylinder assembly in accordance with claim 18 wherein said means for coupling comprises a bracket engaging said main cylinder rod and coupled to said auxiliary cylinder rod.

20. A hydraulic cylinder assembly comprising:

an elongate main cylinder housing;

a main cylinder rod reciprocably mounted within said main cylinder housing an having an end projecting from one end of said main cylinder housing;

a first elongate auxiliary cylinder housing mounted along said and substantially parallel to said main cylinder housing;

a first auxiliary cylinder rod reciprocably mounted in said first auxiliary cylinder housing;

a piston head coupled to and movable with said first auxiliary cylinder rod within said first auxiliary cylinder so as to divide the interior of said first auxiliary cylinder into first and second chambers;

first means for coupling said first auxiliary cylinder rod for movement with said main cylinder rod so that the volume of said first chamber decreases while the volume of said second chamber increases as said main cylinder rod moves in one direction, and so that the volume of said first chamber increases while the volume of said second chamber decreases as said main cylinder rod moves in the opposite direction;

a second elongate auxiliary cylinder housing mounted along side and substantially parallel to said main cylinder housing and said first auxiliary cylinder housing, said second auxiliary cylinder housing having a hollow interior of predetermined volume and further having an opening at one end communicating with said hollow interior;

a second auxiliary cylinder rod extending into said hollow interior of said second auxiliary cylinder housing through said opening and reciprocable relative to said second auxiliary cylinder housing so as to displace a variable volume within said hollow interior of said second auxiliary housing substantially equal to the volume of the portion of said second auxiliary cylinder rod extending into said hollow interior of said second auxiliary cylinder housing at any time; and second means for coupling said second auxiliary cylinder rod for movement with said main cylinder rod so as to progressively withdraw said second auxiliary cylinder rod from said second auxiliary cylinder housing as said main cylinder rod moves in said one direction, and to progressively insert said second auxiliary cylinder rod into said second auxiliary cylinder housing as said main cylinder rod moves in said opposite direction.

21. A hydraulic cylinder assembly in accordance with claim 20 wherein said first and second means for coupling comprise a single bracket engaging said main cylinder rod and coupled to said first and second auxiliary cylinder rods.

22. In an aerial lift having a tower assembly, the tower assembly including an upper boom, a lower boom, an upper hydraulic cylinder assembly having a cylinder and a piston for raising the upper boom relative to the lower boom, and a passenger platform supported by the tower assembly, a platform leveling system comprising:

a hydraulically actuated motor supported by the tower assembly and operable to pivot the passenger platform around a substantially horizontal axis; and means for responsive to raising of the tower assembly for hydraulically actuating said motor to maintain the passenger platform in a substantially constant predetermined orientation relative to vertical as the tower assembly is raised and lowered, said hydraulically actuated motor being positioned adjacent the passenger platform and said means for hydraulically actuating said motor being remote from said hydraulically actuated motor, the means for hydraulically actuating the motor including an auxiliary cylinder assembly responsive to extension of the upper hydraulic cylinder so as to discharge to the hydraulically actuated motor a quantity of hydraulic fluid proportional to the degree of extension of the upper hydraulic cylinder assembly, and the auxiliary cylinder assembly being fixed to the upper hydraulic cylinder assembly such that extension of the upper hydraulic cylinder assembly causes extension of the auxiliary cylinder assembly.

23. A platform leveling system in accordance with claim 22 wherein said auxiliary cylinder assembly includes an auxiliary cylinder and an auxiliary piston rod, one of said auxiliary cylinder and said auxiliary piston rod being fixed to said cylinder of said upper hydraulic cylinder assembly and the other of said auxiliary cylinder and said auxiliary piston rod being fixed to said piston of said upper hydraulic cylinder assembly.

24. An aerial lift comprising:

a tower assembly including a lower boom and an upper boom, said upper boom having a proimate end pivotably connected to one end of said lower boom and a distal end opposite said proximate end;

a bucket mounted to said distal end of said upper boom;

hydraulic means adjacent said distal end of said upper boom for causing tilting movement of said bucket relative to said upper boom around a substantially horizontal axis;

means for controllably varying the angle of said upper boom relative to said horizontal axis so as to controllably extend and retract said lower tower assembly, said means for controllably varying the angle of said boom including an upper hydraulic cylinder assembly; and means responsive to extension of said tower assembly for actuating said hydraulic means so as to tilt said bucket relative to said upper boom as said angle of said upper boom relative to horizontal changes and thereby maintain said bucket in a substantially constant predetermined orientation relative to vertical as said tower assembly is extended and retracted, and said means responsive to extension of said tower assembly responding to extension and retraction of said upper hydraulic cylinder assembly, said hydraulic means adjacent said distal end of said upper boom comprising a rotary actuator and said means responsive to extension of said tower assembly forces hydraulic fluid to said rotary actuator in one direction in response to extension of said upper hydraulic cylinder assembly and forces hydraulic fluid to said rotary actuator in the opposite direction in response to retraction of said upper hydraulic cylinder assembly, and said means responsive to extension of said tower assembly including first and second auxiliary cylinder assemblies coupled to said upper hydraulic cylinder assembly, one of said first and second auxiliary cylinder assemblies being adapted to discharge hydraulic fluid to said rotary actuator in response to extension of said upper hydraulic cylinder assembly and the other of said first and second auxiliary cylinder assemblies being adapted to discharge hydraulic fluid to said rotary actuator in response to retraction of said upper hydraulic cylinder assembly.

25. An aerial lift in accordance with claim 24 wherein said first and second auxiliary cylinders are fixed to said upper hydraulic cylinder assembly such that extension of said upper hydraulic cylinder assembly causes extension of said first and second auxiliary cylinders.

26. An aerial lift in accordance with claim 25 wherein each of said first and second auxiliary cylinder assemblies includes a cylinder and a piston rod, one of said cylinder or piston rod being fixed to the cylinder of said upper hydraulic cylinder assembly and the other of said cylinder and piston rod being fixed to the piston rod of said upper hydraulic cylinder assembly.

27. An aerial lift-comprising:

a support structure;

a lower boom having a lower end pivotably connected to said support structure and an upper opposite said lower end;

an upper boom having a proximate end pivotably connected to said upper end of said lower boom, said upper boom further having a distal end opposite said proximate end and a longitudinal axis extending between said distal and proximate ends;

a bucket carried at said distal end of said upper boom, said bucket having an upper portion and a lower portion and having a longitudinal axis extending between said upper and lower portions;

a hydraulically operated rotary actuator mounted to said distal end of said upper boom and coupled to said bucket so as to controllably rotate said bucket around a substantially horizontal axis and thereby vary the angle between said longitudinal axis of said bucket and said longitudinal axis of said upper boom;

a first hydraulic cylinder operable to vary the angle of said lower boom relative to said support structure;

a second hydraulic cylinder having an extendable and retractable rod coupled to said upper boom and operable to vary the angle of said upper boom relative to said lower boom in response to extension and retraction of said rod;

an auxiliary cylinder actuable in response to extension and retraction of said rod to supply hydraulic fluid to said rotary actuator, in a quantity substantially proportional to the extension of said rod, and thereby actuate said rotary actuator so as to maintain a substantially constant predetermined angle between said longitudinal axis of said bucket and said longitudinal axis of said upper boom as said rod is extended and retracted, said pair of auxiliary cylinders arranged so that one of said auxiliary cylinders supplies hydraulic fluid to said rotary actuator in response to extension of said rod while the other of said auxiliary cylinders supplies fluid to said rotary actuator in response to retraction of said rod.

28. An aerial lift in accordance with claim 27 wherein said auxiliary cylinders are arranged so that as one of said auxiliary cylinders supplies hydraulic fluid to said rotary actuator, the other of said auxiliary cylinders receives hydraulic fluid discharged from said rotary actuator.

29. A hydraulic cylinder assembly for controlling the extension of an upper boom relative to a lower boom in an aerial lift having a tower assembly, said hydraulic cylinder assembly comprising:

an elongate main cylinder housing;

a main cylinder rod reciprocably mounted within said main cylinder housing for reciprocative movement between an extended position and a retracted position; and means responsive to extension and retraction of said main cylinder rod for discharging under pressure, and in response to extension of said cylinder rod, a quantity of hydraulic fluid substantially proportional to the degree of extension of said main cylinder rod, said means responsive to extension and retraction of said main cylinder rod including a first auxiliary cylinder having a first auxiliary cylinder housing and a first auxiliary cylinder rod arranged and coupled to said main cylinder so that movement of said main cylinder rod relative to said main cylinder housing results in movement of said first auxiliary cylinder rod relative to said first auxiliary cylinder housing.

30. A hydraulic cylinder assembly in accordance with claim 29 wherein said first auxiliary cylinder rod defines, within said first auxiliary cylinder housing, a first chamber and wherein the volume of said first chamber varies in accordance with the position of said main cylinder rod within said main cylinder housing.

31. A hydraulic cylinder assembly in accordance with claim 30 further comprising a second auxiliary cylinder having a second auxiliary cylinder housing and a second auxiliary cylinder rod arranged so that reciprocative movement of said main cylinder rod within said cylinder housing results in movement of said second auxiliary cylinder rod relative to said second auxiliary cylinder housing.

32. A hydraulic cylinder assembly in accordance with claim 30 wherein said second auxiliary cylinder rod defines, within said second auxiliary cylinder housing, an additional chamber having a volume related to the position of said main cylinder rod relative to said main cylinder housing.

33. A hydraulic cylinder assembly in accordance with claim 32 wherein said first and second auxiliary cylinders are arranged such that, in response to movement, in a first direction of said main cylinder rod relative to said main cylinder housing the volume of said first chamber increases while the volume of said other chamber decreases and so that, in response to movement, in the opposite direction, of said main cylinder rod relative to said main cylinder housing, the volume of said other chamber increases while the volume of said first chamber decreases.

34. A hydraulic cylinder assembly in accordance with claim 33 wherein the volume said first chamber decreases in response to movement of said main cylinder rod in one direction substantially equals the volume said other chamber increases, and wherein the volume said other chamber decreases in response to movement of said main cylinder rod in the opposite direction substantially equals the volume said first chamber increases.

* * * * *